US005226470A

United States Patent [19]

Lemoine et al.

[11] Patent Number: 5,226,470

[45] Date of Patent: Jul. 13, 1993

[54] EXPENDABLE CERAMIC MANDREL

[75] Inventors: Philip M. Lemoine, Seattle; Charles W. Newquist, Issaquah, both of Wash.

[73] Assignee: The Boeing Company, Seattle, Wash.

[21] Appl. No.: 438,769

[22] Filed: Nov. 17, 1989

[51] Int. Cl.[5] ..... B22C 9/10; B22C 1/08

[52] U.S. Cl. ..... 164/132; 164/369; 164/529; 106/38.9

[58] Field of Search ..... 164/15, 522, 529, 132, 164/349, 369, 520; 106/38.2, 38.9

[56] References Cited

U.S. PATENT DOCUMENTS

| | | | |
|---|---|---|---|
| 3,649,342 | 3/1972 | Bartlett | 501/91 |
| 3,698,467 | 10/1972 | Fassler et al. | 164/132 |
| 3,852,099 | 12/1974 | Prochazka | 501/91 |
| 3,862,660 | 1/1975 | Sakabe et al. | 164/520 |
| 4,026,344 | 5/1977 | Greskovich | 164/519 |
| 4,108,672 | 8/1978 | Klug et al. | 164/529 |
| 4,162,173 | 7/1979 | Arendt | 164/132 |
| 4,353,389 | 10/1982 | Engl | 137/375 |
| 4,441,930 | 4/1984 | Baudis | 164/132 |
| 4,572,272 | 2/1986 | Mills | 164/132 |
| 4,709,741 | 12/1987 | Nakamura | 164/35 |
| 4,830,083 | 5/1989 | Nakamura | 164/35 |
| 4,840,219 | 6/1989 | Foreman | 164/529 |
| 4,852,347 | 8/1989 | Reynolds | 60/253 |

FOREIGN PATENT DOCUMENTS

| | | | |
|---|---|---|---|
| 56163 | 7/1982 | European Pat. Off. | 164/529 |
| 1021880 | 3/1966 | United Kingdom | 414/459 |
| 1602027 | 11/1981 | United Kingdom | 164/132 |

*Primary Examiner*—Richard K. Seidel
*Assistant Examiner*—Rex E. Pelto
*Attorney, Agent, or Firm*—Christensen, O'Connor, Johnson & Kindness

[57] ABSTRACT

Expendable mandrels and methods of using such mandrels for forming voids within materials or surfaces on materials deposited onto the mandrels are described. The mandrels have a coefficient of thermal expansion that substantially matches that of the material to be deposited on the mandrel. Matching coefficients of thermal expansion reduces the likelihood of cracking of the base material when the mandrel and base material are cooled.

21 Claims, 2 Drawing Sheets

EXPENDABLE CERAMIC MANDREL

This invention was made with Government support under Contract No. DASG60-88-C-0099 awarded by the Department of the Army. The Government has certain rights in the invention.

FIELD OF THE INVENTION

The present invention relates to expendable supports, for example mandrels, for forming deposited articles that conform to the shape of the support. The present invention also relates to methods of forming articles using such supports and to the products produced by such methods.

BACKGROUND OF THE INVENTION

Passageways or conduits through a solid structure can be provided by depositing a base material for the structure onto a removable support having a profile shaped to provide the desired length and cross section of the passageway within the structure. Briefly, the base material is deposited onto the support so that when the support is removed, a passageway will remain. This concept can be used to form conduits or tubes of various sizes, nozzles and the like. Depending on the composition of the base material and the technique used to deposit the base material, the support should be resistant to high temperatures, caustic conditions, large shifts in temperature, and other conditions characteristic of the particular method used to deposit the base material.

One article that can be produced by the technique similar to the one briefly described above is a nozzle that accelerates and directs exhaust gases from a combustion chamber. In the past, nozzles of this type, particularly small nozzles having passageways with diameters on the order of 1.0 centimeter or less, have been made by depositing a base material on a mandrel made from a metal, for example, molybdenum. Metal mandrels normally require extensive and expensive machining to provide the desired shape within close tolerances. In addition, the metals used in the past had to be tolerant to high temperatures and were expensive. Because the mandrels are often destroyed to remove them from the deposited article, it is not economical to make them from expensive starting materials using costly manufacturing techniques.

Prior techniques regularly failed when making small ceramic nozzles or other conduits because of cracking related to differential thermal expansions between the mandrel and the deposited ceramic when the mandrel and deposited ceramic were cooled following deposition.

SUMMARY OF THE INVENTION

A method of the present invention and the mandrels formed in accordance with that method address the problems described above. The method uses a mandrel made from materials that are less expensive than those previously used to make high temperature metal mandrels for electro-deposition, chemical vapor deposition, or plasma spraying. In addition, the mandrels formed in accordance with the present invention can be made without the expensive machining processes that have been used to form metal mandrels. The method and the mandrels of the present invention also reduce or eliminate cracking of the deposited articles during cooling.

The present method achieves these benefits by forming a ceramic mandrel from a mixture of at least two materials. The mandrel has a coefficient of thermal expansion that substantially matches the coefficient of thermal expansion of the base material to be deposited. Preferably, the mandrel formed in accordance with the present invention can be dissolved to recover the deposited article.

The method can be used to form high precision passageways or other voids having simple or complex shapes, and can be used in conjunction with base materials that are deposited at high temperatures.

Other features and advantages of the present invention will be readily apparent from the following description of certain preferred embodiments thereof, taken in conjunction with the accompanying drawings. It is understood that variations and modifications may be effective without departing from the spirit and scope of the novel concepts of the disclosure.

DETAILED DESCRIPTION OF THE INVENTION

Figure 1:
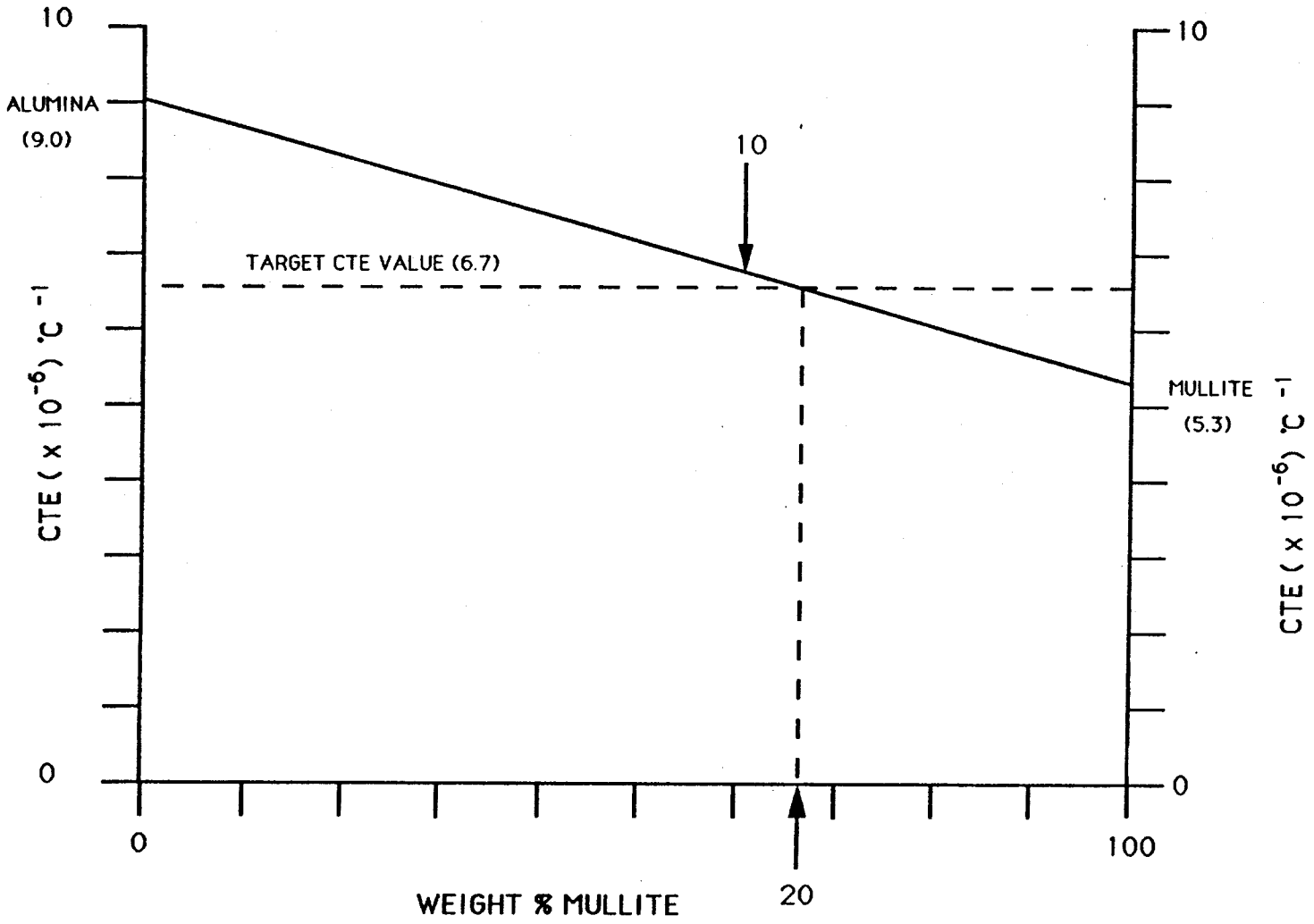
FIG. 1 is a graph showing a rule of mixture used in accordance with the present invention to prepare a ceramic mixture for a mandrel onto which rhenium is to be deposited.

As briefly described above, the method of the present invention involves depositing a base material onto a shaped mandrel to form an article and separating the article from the mandrel by dissolving the mandrel. The method can be used to provide passageways or conduits in otherwise solid articles. Alternatively, the method can be used to provide features on the exterior of articles comprising the deposited base material. The method involves the steps of first preparing a mixture of at least two ceramic or refractory materials from which the mandrel will be formed. The components of the mixture are selected such that the mandrel has a coefficient of thermal expansion (CTE) substantially matching that of the base material. The mandrel is then formed having a shape that will provide the desired feature in the deposited article. After the base material is deposited onto the mandrel, and the combination is cooled, the mandrel is dissolved to free the deposited article. A more detailed description of each of the individual steps described above and the materials used in each of the steps for a specific application follows.

While the following description is in the context of forming nozzles and valves, it should be understood that the present invention is not limited to the production of nozzles and valves.

Base materials that can be deposited onto a mandrel formed in accordance with the present invention, include those materials that can be deposited by techniques that are carried out at either elevated temperatures or require subsequent high temperature treatments, for example, electro-deposition, chemical vapor deposition, and plasma spraying. Generally, these processes are carried out at a temperature of about 1000° C. or above. Examples of base materials that can be deposited by these types of techniques include refractory metals like tungsten, iridium, tantalum, rhenium, or ceramics like silicon carbide, hafnium carbide, silicon nitride, boron nitride, tungsten carbide, tantalum nitride and hafnium silicide. Although the refractory metals and ceramics described above can be deposited by chemical vapor deposition or plasma spraying, only the refractory metals can be deposited by electro-deposition techniques. When nozzles for the exhaust of gases at high temperatures (i.e. hot gas valves) are formed, it is preferred that rhenium or silicon carbide be used as the base material because of their high temperature stability and resistance to oxidation. Exemplary properties of rhenium include a melting point of about 3180° C. and a coefficient of thermal expansion (CTE) of about $6.65\times10^{-6}$° C.$^{-1}$. Silicon carbide has a melting point of about 2700° C. and a coefficient of thermal expansion of about $2.4\times10^{-6}$° C.$^{-1}$.

By matching the coefficient of thermal expansion of the mandrel with the coefficient of thermal expansion of the base material, cracking of the deposited base material when the mandrel and base material both experience shifts in temperature is avoided. After the base material is deposited onto the mandrel, the mandrel and deposited base material are cooled. Because a certain degree of adhesion occurs between the surface of the mandrel and the base material, if the two have coefficients of thermal expansion that are significantly different, stresses that can crack the deposited base material are created.

It is possible, due to the way the mandrel is formed, that the coefficient of thermal expansion of the formed mandrel may not match the coefficient of thermal expansion of the mixture from which the mandrel is formed. In other words, the formed mandrel may or may not have the same coefficient of thermal expansion as the mixture. In the context of the preferred ceramic mandrels described below, the coefficient of thermal expansion of the mixture before and after forming the mandrel substantially matches the predetermined coefficient of thermal expansion of the base material. If it does, the rule of mixtures can easily be used to predict the coefficient of thermal expansion of the formed mandrel. Otherwise, a further correlation is required to compensate for the CTE change that occurs when the mandrel is formed.

Because the coefficient of thermal expansion of the mandrel is matched with the CTE of the base material, cracking of the deposited article is minimized or eliminated when the temperature of the mandrel and article changes. The mandrel and article expand or contract together and induced stresses are minimized.

The use of a ceramic mandrel has the added advantage that such materials can be dissolved readily with a solvent such as a molten alkali salt that does not affect the physical or chemical integrity of the deposited layer, generally rhenium or silicon carbide. Depending upon the base material, other ceramic mixtures can be used to match the coefficient of thermal expansion of the mandrel with that of the base material.

The mandrel can be formed from nonceramic mixtures. The choice of the materials will depend on the coefficient of thermal expansion of the base material. If two materials are used, one material must have a coefficient of thermal expansion that is greater than the CTE of the base material and the other material must have a CTE that is less than the coefficient of the base material, as will be understood by those of ordinary skill since the final CTE is a composition weighted average of the CTEs of the separate components.

For rhenium, a mandrel comprising a sintered mixture of aluminum oxide and mullite ($3Al_2O_3$-$2SiO_2$) has a CTE that substantially matches that of rhenium. Mullite is a stable form of aluminum silicate and can be formed by heating other aluminum silicates such as cyanite, sillimanite or andalusite to high temperatures. Mullite has a CTE of about $5.3\times10^{-6}$° C.$^{-1}$. Aluminum oxide (alumina) can be derived by leaching bauxite with caustic soda followed by precipitation of hydrated aluminum oxide by hydrolysis and seeding of the solution. The alumina hydrate is then washed, filtered and calcined to remove water and obtain the anhydrous oxide. Aluminum oxide has a CTE of about $9.0\times10^{-6}$° C.$^{-1}$.

For depositing rhenium, a preferred mandrel includes a sintered mixture of mullite and aluminum oxide in a weight ratio of about 1.43:1.00. Because mullite contains aluminum oxide, this weight ratio provides a ceramic that includes about 83.4 weight percent aluminum oxide. This specific weight ratio was predicted by using the graph shown in FIG. 1. FIG. 1 includes line 10 that illustrates a linear plot of the coefficient of thermal expansion (CTE) versus the phase content for a mixture of mullite and aluminum oxide. The point 20 (about 76.0 weight percent mullite) on the x-axis represents the specific weight ratio described above. The rule of mixtures for mullite and aluminum oxide illustrated in FIG. 1 assumes that the coefficient of thermal expansion of the mixture is a linear function of the ratio of the components in the mixture, which has proven to be a valid assumption.

Generally, high purity, 325 mesh mullite and aluminum oxide in the weight ratio described above are mixed with about 5.0 weight percent cellulose ether (available under the name METHOCEL TM from the Dow Chemical Company). METHOCEL TM is a fugitive organic binder. The mixture of mullite, aluminum oxide, and binder is ball-milled for about 24 hours. The powder is then formed into a mandrel by molding, extruding, pressing or casting techniques. The preferred forming technique will depend in part of the complexity of the shape of the mandrel. Each of the techniques will result in a compacted body that is ready for sintering. If surface imperfections are present after the forming step, they should be rmmoved prior to the sintering step. The specific sintering schedule will depend on the particular binders used and the technique of forming the mandrel. For a mandrel in the shape of a square billet about 3.0 inches long and 0.25 inches wide and 0.25 inches high that is formed by isostatically pressing the powder at about 40,000 psi, an exemplary schedule includes:

- heating the "green" mandrel from about 25° to about 300° C. over about 4 hours;
- holding the temperature at about 300° C. for 5 hours;
- slowly raising the temperature to about 1600° C. over about 13 hours; and
- holding the temperature at about 1600° C. for 36 hours to complete the mandrel.

The sintered mixture has a bulk density of about 2.809 grams per cubic centimeter and a open porosity of about 16.46% as determined by water saturation density measurements. Using a dilatometer to measure the CTE of the sintered mixture over a temperature range of about 25°-1200° C., an average CTE of $6.66\times10^{-6}$° C.$^{-1}$ was determined, which compares favorably to the CTE of rhenium that is about $6.65\times10^{-6}$° C.$^{-1}$.

To evaluate the resistance of the ceramic to the high temperatures associated with chemical vapor deposition or subsequent treatment steps associated with electro-deposition, the sintered ceramic was subjected to a 1000° C. hydrogen annealing cycle. The sintered ceramic was unaffected by the cycle.

The sintered mixture of mullite and aluminum oxide can be dissolved by a molten alkali salt, for example sodium carbonate at about 950° C. or greater. The sodium carbonate reacts with the aluminum oxide in the ceramic to form a reaction product ($NaAlO_2$) that is water soluble. Although the silicon dioxide portion of the mullite is not dissolved by the molten sodium carbonate, it remains as a powder after the water soluble reaction product is removed. Accordingly, other ceramics that include aluminum oxide as one phase and another ceramic precursor as another phase can also be dissolved by molten alkali salts. As with the mullite/aluminum oxide ceramic, the phase that is not dissolved by the molten alkali salt will likely remain as a powder or particulate after the water soluble reaction product is removed. This powder can be removed thereafter. The length of time that the ceramic must be contacted with the molten sodium carbonate will depend on a number of factors including the thickness of the ceramic, the ability of the molten sodium carbonate to permeate into the mandrel, and the temperature of the molten salt. In the context of the billet described above, 5.0 hours was required to dissolve it. It should be understood that although molten sodium carbonate is described above as being suitable for removing or dissolving the mullite/aluminum oxide ceramic, other molten alkali metal salts or mixtures thereof such as potassium carbonate, potassium chloride, and sodium chloride could provide similar results provided that such alternative molten alkali salts do not effect the base material deposited on the mandrel. We prefer to use sodium carbonate, potassium carbonate or mixtures of the two.

For depositing silicon carbide or a mixture of silicon carbide and hafnium carbide, we use a sintered ceramic mandrel comprising aluminum oxide and cordierite. Cordierite derives from agrillaceous sediments and has a coefficient of thermal expansion of about $2.08\times10^{-6}$° C.$^{-1}$.

Figure 2:
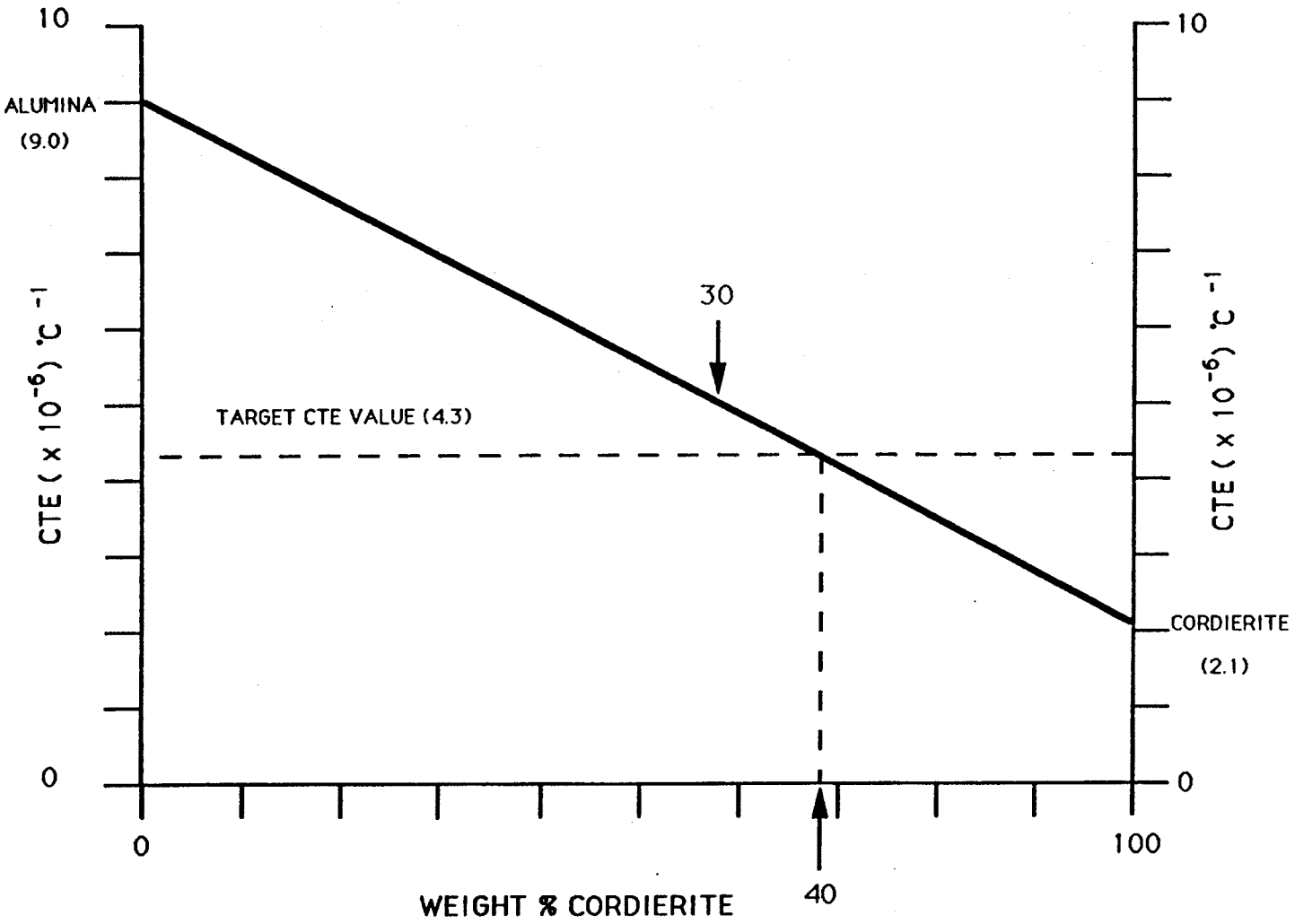
FIG. 2 is a graph showing a rule of mixtures used in accordance with the present invention to prepare a ceramic mixture for a mandrel onto which silicon carbide is to be deposited.

Specifically, a sintered mixture of ceramic precursors comprising about 68.1 weight percent cordierite ($2MgO.2Al_2O_3.5SiO_2$) and about 31.9 weight percent aluminum oxide (a weight ratio of 2.14:1.0) has a coefficient of thermal expansion that substantially matches that of silicon carbide. This specific composition was predicted using the graph shown in FIG. 2. FIG. 2 includes line 30 that illustrates the linear relationship (rule of mixtures) between the theoretical coefficient of thermal expansion (CTE) for aluminum oxide and cordierite and the phase content of a mixture of the two. The point 40 on the x-axis represents the specific composition described above.

A mandrel comprising cordierite and aluminum oxide is made, just as with the rhenium mandrel, by forming a green compact of the aluminum oxide and cordierite in the shape of the mandrel and then sintering the green compact. The green compact can be shaped by any of the techniques described above in the context of a ceramic comprising aluminum oxide and mullite. The mixture of aluminum oxide and cordierite that is formed into the green compact is prepared by mixing 325 mesh, high purity, powders and an organic binder such as METHOCEL TM (5.0 wt. percent) followed by milling as described above. Since the aluminum oxide and cordierite mixture have an eutectic at about 1,450° C., the mixture is sintered at temperatures below 1,450° C. to avoid excessive liquid formation. For a mandrel that has been formed in the shape of a square billet about 3.0 inches long and about 0.25 inches high and 0.25 inches wide by isostatically pressing at about 40,000 psi, the sintering schedule set forth below provides a ceramic that: (1) has a coefficient of thermal expansion that substantially matches that of silicon carbide; and (2) can be dissolved by a molten alkali salt. The exemplary schedule includes:

heating the "green" mandrel from about 25° to about 300° C. over about 4 hours;

holding the temperature at about 300° C. for 5 hours;

slowly raising the temperature to about 1600° C. over about 13 hours; and holding the temperature at about 1600° C. for about 36 hours to complete the mandrel.

Based on the rule of mixtures in FIG. 2, the thermal coefficient of expansion for a ceramic having a composition described above comprising cordierite and aluminum oxide over a temperature range of about 25°-1200° C. is about $4.3\times10^{-6}$° C.$^{-1}$. The aluminum oxide and cordierite mandrel is also unaffected by exposure to a one hour, 1,000° C. hydrogen annealing cycle allowing its use in an electro-deposition process. The aluminum oxide/cordierite ceramic billet is soluble in molten alkali salts.

Applicants have found that the conditions under which the ceramic precursors are sintered affects: (1) the solubility of the sintered ceramic in the molten alkali salt; and, (2) the relationship of the CTE of the mixture of ceramic precursors and the CTE of the sintered ceramic. By carefully controlling the temperature and the time distribution of the sintering process, the ceramic precursors are prevented from interacting in a manner that would reduce the solubility of the aluminum oxide phase in the alkali metal salt. Preferably, the ceramic precursors remain as discrete grains in the sintered ceramic. When the phases remain as discrete grains, the coefficient of thermal expansion of the sintered ceramic is the same as that of the mixture of the ceramic precursors.

The mandrels formed in accordance with the present invention can be shaped by techniques known for shaping and forming green ceramic compacts. For example, slip casting, extrusion, injection molding, and similar techniques can be used. Injection molding is a preferred technique from the standpoint of simplicity and reproducibility of dimensions of the mandrel. After the green compact in the shape of the mandrel has been formed, it is subjected to the sintering schedule as described above. If the green compact has surface imperfections, they should be removed prior to sintering the green compact. Alternatively, a mandrel can be machined from a green compact of ceramic precursors or from a sintered block of ceramic similar to the way that prior metal mandrels have been formed.

After the mandrel has been formed, sintered, and finished as described above, the rhenium or silicon carbide or other base material can be deposited thereon using techniques such as chemical vapor deposition, electro-deposition, or plasma spraying. In the context of depositing rhenium and silicon carbide, chemical vapor deposition is preferred because it generally only requires one depositing step. In contrast, although electro-deposition can be used to deposit rhenium, this technique generally requires several depositing steps with intermediate annealing steps. Using the deposition techniques described above, rhenium and silicon carbide layers having a thickness ranging from about 0.01 mils to about 0.1 inch (100 mils) can be deposited onto many shapes of mandrels.

After the base material is deposited, the mandrel and deposited base material must be cooled, preferably to about room temperature. During this cooling process, the mandrel and the deposited material formed in accordance with the present invention contract together because their coefficients of thermal expansion match. Accordingly, stresses within the base material induced by the mandrel that may cause cracking of the base material are avoided.

The aluminum oxide and mullite, and the aluminum oxide and cordierite ceramics used to form mandrels in accordance with the present invention can be dissolved by molten alkali salts, such as sodium carbonate. At least one surface of the mandrel must remain accessible so that the molten alkali salt can react with the ceramic. Preferably, more than one surface of the mandrel is uncovered so that the surface area of contact between the mandrel and the solvent is as large as possible. The larger the surface area of contact, the faster the reaction between the ceramic and the molten alkali salt. If the design of the mandrel allows, passageways for the molten alkali salt should be provided throughout the mandrel to increase the surface area of contact with the salt and to promote the speed with which the mandrel is dissolved. The conditions, such as temperature, under which the solvent is used to dissolve the mandrel should not adversely affect the deposited base material. Although the dissolving step destroys the mandrel, the relatively inexpensive starting materials used to make the mandrel and the relatively inexpensive techniques used to form the mandrel make dissolving the mandrel more economically acceptable.

The method and mandrels of the present invention allow small, high precision passageways or conduits to be provided within solid bodies of the deposited base material. Because the mandrels can be formed by techniques that provide highly reproducible shapes to close tolerances, the passageways within the deposited material likewise can be reproducibly made to close tolerances. A tube having a smooth outer surface can be made by depositing the base material on the interior of a tubular mandrel. That is, the mandrel can have either male or female features.

It is to be understood that modifications and changes to the preferred embodiments of the invention herein described and shown can be made without departing from the spirit and scope of the invention.

We claim:

1. A method for producing an article from rhenium, the method comprising the steps:

(a) preparing a mixture comprising aluminum oxide and mullite that includes a weight ratio of mullite to aluminum oxide of about 1.43:1.0 and forming a mandrel from the mixture, the mandrel having a coefficient of thermal expansion substantially matching that of rhenium;

(b) depositing the rhenium on the mandrel at an elevated temperature;

(c) cooling the mandrel and the rhenium; and (d) separating the rhenium from the mandrel.

2. The method of claim 1, wherein said separating step includes dissolving the mandrel.

3. The method of claim 2, wherein said dissolving includes contacting the mandrel with a molten alkali metal salt.

4. The method of claim 3, wherein said molten alkali metal salt is selected from the group consisting of sodium carbonate, potassium carbonate and mixtures thereof.

5. A method for producing an article from silicone carbide, the method comprising the steps:

(a) preparing a mixture comprising cordierite and aluminum oxide that includes a weight ratio of cordierite to aluminum oxide of about 2.14:1.0 and forming a mandrel from the mixture, the mandrel having a coefficient of thermal expansion substantially matching that of silicon carbide;

(b) depositing the silicon carbide on the mandrel at an elevated temperature;

(c) cooling the mandrel and the silicon carbide; and (d) separating the silicon carbide from the mandrel.

6. The method of claim 5, wherein said separating step includes dissolving the mandrel.

7. The method of claim 6, wherein said dissolving includes contacting the mandrel with a molten alkali metal salt.

8. The method of claim 7, wherein said molten alkali metal salt is selected from the group consisting of sodium carbonate, potassium carbonate and mixtures thereof.

9. A method for producing an article from a base material having a predetermined coefficient of thermal expansion, the method comprising the steps:

(a) preparing a mixture of at least two ceramic precursors selected from the group consisting of aluminum oxide, mullite, cordierite and forming a mandrel from the mixture, the mandrel having a coefficient of thermal expansion substantially matching that of the base material;

(b) depositing the base material on the mandrel at an elevated temperature;

(c) cooling the mandrel and the base material; and (d) separating the base material from the mandrel by contacting the mandrel with a molten alkali metal salt to convert at least one ceramic precursor to a water soluble component and dissolving the water soluble component.

10. The method of claim 9, wherein the molten alkali metal salt is selected from the group consisting of sodium carbonate, potassium carbonate and mixtures thereof.

11. The method of claim 9, wherein the mandrel includes aluminum oxide.

12. The method of claim 11, wherein the molten alkali metal salt is sodium carbonate.

13. The method of claim 9, wherein the molten alkali metal salt is at a temperature of 950° C. or greater.

14. A method for producing a hot gas valve from a base material by depositing the base material onto a mandrel, the method comprising the steps:

(a) forming the mandrel from a ceramic precursor;

(b) depositing the base material on the mandrel at an elevated temperature;

(c) cooling the mandrel and the base material; and (d) contacting the mandrel with a molten alkali metal salt to convert the ceramic precursor to a water-soluble component and dissolving the water-soluble component.

15. The method of claim 14, wherein the molten alkali metal salt is selected from the group consisting of sodium carbonate, potassium carbonate and mixtures thereof.

16. The method of claim 14, wherein the base material is a refractory metal or a ceramic.

17. The method of claim 16, wherein the metal is selected from the group consisting of rhenium, tungsten, iridium, tantalum, and mixtures thereof.

18. The method of claim 16, wherein the base material comprises rhenium.

19. The method of claim 16, wherein the base material comprises silicon carbide.

20. The method of claim 16, wherein the base material comprises silicon carbide, hafnium carbide, and mixtures thereof.

21. An expendable mandrel for making rhenium hot gas valves, the mandrel comprising:

a sintered mixture of ceramic precursors each having a melting point in excess of 1,000° C., said sintered mixture having a coefficient of thermal expansion substantially equal to that of rhenium, wherein at least one of the ceramic precursors is converted to a water soluble component when contacted with a molten alkali metal salt.

* * * * *

UNITED STATES PATENT AND TRADEMARK OFFICE

CERTIFICATE OF CORRECTION

PATENT NO. : 5,226,470

DATED : July 13, 1993

INVENTOR(S) : P. M. Lemoine et al.

It is certified that error appears in the above-identified patent and that said Letters Patent is hereby corrected as shown below:

On the title page, item [56] insert the following:

Please add --3,022,230 2/1962 Fialkoff .....204/9--

Please add --3,072,983 1/1963 Brenner et al. .....22/200--

Please add --3,467,583 9/1969 Naimer .....204/9--

Please add --3,897,316 7/1975 Huang.....204/9--

Please add --3,939,046 2/1976 Conn et al. .....204/4--

Please add --3,969,199 7/1976 Berdan et al. .....204/33--

Please add --4,079,254 3/1978 Lawrence, Jr. et al. .....250/292--

Please add --4,106,744 8/1978 Lawrence, Jr. et al. .....249/96--

Please add --4,202,080 5/1980 Holzl et al. .....29/25.18--

UNITED STATES PATENT AND TRADEMARK OFFICE

CERTIFICATE OF CORRECTION

PATENT NO. : 5,226,470

DATED : July 13, 1993

INVENTOR(S) : P. M. Lemoine et al.

It is certified that error appears in the above-identified patent and that said Letters Patent is hereby corrected as shown below:

| COLUMN | LINE | |
|---|---|---|
| 2 | 22 | "mixture" should read --mixtures-- |
| 4 | 45 | "rmmoved" should read --removed-- |
| 8 (Claim 5, | 8 Line 1) | "silicone" should read --silicon-- |

Signed and Sealed this

Twenty-second Day of March, 1994

*Attest:*

Bruce Lehman

BRUCE LEHMAN

*Attesting Officer*

*Commissioner of Patents and Trademarks*